US007249980B2

(12) United States Patent
Ferderer

(10) Patent No.: US 7,249,980 B2
(45) Date of Patent: Jul. 31, 2007

(54) CONNECTING DEVICE FOR BUNCHED CONDUCTORS

(75) Inventor: Albert Ferderer, Espelkamp (DE)

(73) Assignee: Harting Electric GmbH & Co., KG (DE)

( * ) Notice: Subject to any disclaimer, the term of this patent is extended or adjusted under 35 U.S.C. 154(b) by 0 days.

(21) Appl. No.: 11/426,108

(22) Filed: Jun. 23, 2006

(65) Prior Publication Data

US 2007/0010135 A1 Jan. 11, 2007

(30) Foreign Application Priority Data

Jul. 5, 2005 (DE) ..... 10 2005 031 281

(51) Int. Cl.
*H01R 4/48* (2006.01)

(52) U.S. Cl. ..... 439/729; 439/863

(58) Field of Classification Search ..... 439/393, 439/427, 595, 729, 861–863
See application file for complete search history.

(56) References Cited

U.S. PATENT DOCUMENTS 4,097,101 A * 6/1978 Holt et al. ..... 439/82
4,162,819 A * 7/1979 Eisert ..... 439/711
6,752,667 B2 6/2004 Ferderer ..... 439/729

FOREIGN PATENT DOCUMENTS

DE 10145324 4/2003

* cited by examiner

*Primary Examiner*—Khiem Nguyen
(74) *Attorney, Agent, or Firm*—Hayes Soloway P.C.

(57) ABSTRACT

The invention proposes a connecting device for electric bunched conductors in an electric connector housing with male contacts and/or female contacts that are arranged in separate chambers in the form of rows and columns, wherein a clamping sleeve is attached to a sliding element arranged in the chambers. An electric bunched conductor that is inserted into the sliding element and the clamping sleeve attached thereto is pushed over a stationary, conical connecting region of the male or female contacts during an axial movement of the sliding element along the chamber such that the bunched conductors are fixed between the clamping shoulder of the connecting region that is formed by the cone base and the clamping sleeve.

9 Claims, 8 Drawing Sheets

CONNECTING DEVICE FOR BUNCHED CONDUCTORS

FIELD OF THE INVENTION

The invention pertains to a connecting device for electric conductors in a connector housing with female contacts and/male contacts that are arranged in separate chambers.

BACKGROUND OF THE INVENTION

A connecting device of this type is required, in particular, for electric conductors that are realized in the form of bunched conductors.

DESCRIPTION OF THE RELATED ART

DE 101 45 324 C1 discloses an electric connecting element for contacting bunched conductors, the connecting end of which has a saw tooth-like structure, wherein a springable sleeve widened by means of a wedge can be pushed on this saw tooth-like structure.

In this case, it proved disadvantageous that a large number of individual components are required for realizing the function of this connecting element, wherein the number of individual components can be significantly reduced with the proposed invention.

SUMMARY OF THE INVENTION

Consequently, the invention is based on the objective of realizing a connecting device of the initially cited type in such a way that the connection of bunched conductors can be realized with a few simple components and without tools, wherein the connecting device should also cover the broadest range possible of wire cross sections to be contacted.

This objective is attained in that the connecting region features a cone point and a clamping shoulder that is formed by the cone base, in that an axially displaceable sliding element with a through-bore for inserting the bunched conductors is arranged in the chambers, in that a clamping sleeve is fixed in position on the sliding element such that it is axially aligned with the through-bore, and in that the clamping sleeve can be pushed on and pulled off the conical connecting region of the male or female contacts together with the sliding element, wherein a radial force of the clamping sleeve acts upon and fixes the bunched conductors inserted between the clamping sleeve and the clamping shoulder.

The advantage attained with the invention can be seen, in particular, in that this connector housing represents a connector system for bunched conductors that requires no tools, wherein the bunched conductors can be fixed on the connecting regions of the electric plug contacts in the form of male and female contacts by means of a springable sleeve.

In this respect, it should be possible to connect bunched conductors with cross sections between 0.35–1.5 $mm^2$ by means of a clamping device that allows a simple installation. An unproblematic exchange can be realized due to an identical modular dimension with similar connector housings, but different types of terminals, e.g., screw-type terminals.

For this purpose, a plurality of chambers is arranged in the connector housing in the form of rows and columns, wherein one respective clamping device for a bunched conductor is provided in each chamber.

The clamping device in the form of a connecting device for electric bunched conductors is formed by an axially displaceable sliding element that can be pushed on the connecting region of electric contact elements in the form of male or female contacts together with a clamping sleeve. One prerequisite, particularly with respect to bunched conductors, is that the bunched conductors are fed into a contacting region without applying any force so as to largely prevent individual copper cores from twisting or bending before a fastening point is reached.

This means that the bunched conductors need to be fed to the connecting region of a contact element in a continuously accessible fashion in the "installation state," namely until the fastening point of the bunched conductor on the contact element is reached.

During the installation, the stripped section of the bunched conductor is inserted into a bore that extends through the sliding element as well as a clamping sleeve fixed on the sliding element.

The sliding element is subsequently displaced into the connector housing in the connecting direction of the bunched conductor.

In this case, it is advantageous that beads are integrally formed onto both outwardly pointing corner regions of the sliding elements in the direction of displacement, wherein these beads prevent a sliding element from unintentionally sliding off in the direction of the contact element due to the fact that they have a certain oversize referred to the chamber in which they are accommodated.

As the sliding element approaches its end position, the springable designed clamping sleeve is pushed over the conically shaped contacting region of the male and female contacts together with the surrounding bunched conductor. The clamping sleeve is advantageously provided with a continuous, meander-shaped longitudinal slot such that the constricting forces exerted upon a clamping shoulder on the connecting region of the male and female contacts that is formed by the base of the cone is always adapted to the number and the gauge of the bunched conductors.

Any sliding element can be levered back out of the respective chamber in order to simultaneously release the bunched conductor by manipulating a bevel that is provided for this purpose on the outside of each chamber and extends into a recess in the sliding element, namely with a flat, narrow object, e.g., a screwdriver.

BRIEF DESCRIPTION OF THE DRAWINGS

One embodiment of the invention is illustrated in the figures and described in greater detail below. The figures show.

DETAILED DESCRIPTION OF THE INVENTION

Figure 1:
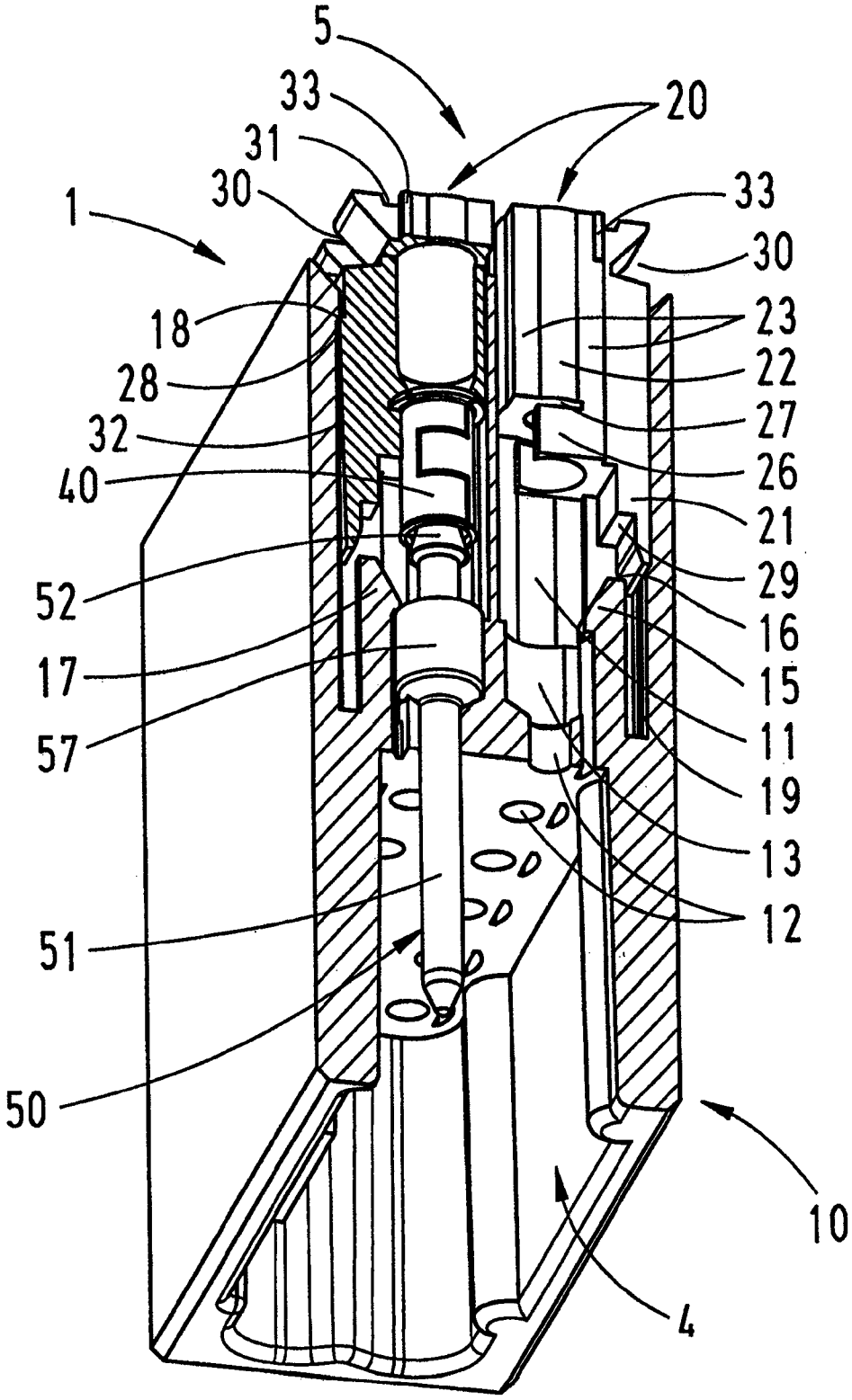
FIG. 1 is a connector half with a housing for male contacts in the form of a sectional representation viewed in the direction of the terminal region.

FIG. 1 shows a perspective sectional representation of a connector half 1 that consists of a housing 10 with male contacts 50 arranged therein.

In this case, the housing 10 features a collar-shaped terminal region 4, into which the male contacts 50 protrude with their terminal side 51, as well as a connecting region 5 that is provided for the connection of bunched conductors.

The connecting region 5 features a plurality of individual chambers 11, in which axially displaceable sliding elements 20 are arranged adjacent to one another in the form of rows and columns.

The male contacts 50 are positioned in the housing 10 in the same configuration.

For this purpose, the male contacts 50 respectively feature a collar 57, by means of which they are inserted into a correspondingly shaped holding region 13 that lies underneath the chambers 11 about centrally referred to the housing 10 and locked therein by catch elements 15.

The pin-shaped terminal side 51 of the male contacts protrudes into the terminal region 4 through openings 12 underneath the holding region 13 while the connecting region 52 is realized with a cone point 53 and a clamping shoulder 54 and extends into the chamber 11.

An axially displaceable sliding element 20 is arranged in each chamber 11, wherein the sliding element is illustrated in an "installation position," in which it partially protrudes from the housing 10.

The sliding element basically features a round body 22 with four corner regions 23 integrally formed thereon such that a square outside contour is achieved, wherein two of these corner regions that lie adjacent to one another transform into a sliding element guide 21.

On this side, the two other corner regions 23 are sectionally provided with a bead 33 that is integrally formed thereon in the direction of displacement and has a slight oversize referred to the chamber 11 in which is accommodated so as to prevent the sliding element 20 from unintentionally sliding off when no bunched conductors are connected.

The sliding element guide 21 is additionally provided with a limit stop 29 that comes in contact with the limit stop 16 of the outer catch element 17 provided for locking the male contact 50.

The sliding element 20 is prevented from falling out of one of the chambers 11 in the housing by means of mutually contacting stopping edges 18, 28 on the outwardly directed side of the sliding element guide 21 and the corresponding side of the chambers 11.

For this purpose, a narrow raised guide rail 32 is integrally formed onto the outwardly directed sliding element guide 21 and engages into a groove 19 on the housing wall.

A through-bore 24 with an outlet 25 that narrows in a funnel-shaped fashion is provided in the center of the sliding element 20.

A clamping sleeve 40 is arranged underneath the funnel-shaped outlet 25, namely such that the clamping sleeve can be inserted into a fork-shaped holder 26 that is adapted to its diameter and simultaneously fixed in a slot 27 of the sliding element arranged above the holder by means of a holding ring 42 formed by the perpendicularly bent edge of the clamping sleeve.

The actual connecting device therefore is formed by the sliding element 20, the clamping sleeve 40 and the conical connecting region 52.

In order to install this connecting device, the male contact 50 is initially inserted into the holding region 13 of the housing 10 and fixed by means of the catch elements 17. Subsequently, the clamping sleeve 40 is connected to the sliding elements 20 and inserted into one of the chambers 11 together therewith until the stopping edges 18 and 28 of the housing and the sliding element contact one another.

This position—in which the sliding element 20 still protrudes from the housing 10—represents the "wiring position," in which a stripped bunched conductor can be inserted into the through-bore 24 in the center of the sliding element 20 until it reaches the clamping sleeve 40 situated there under and then up to the collar 57 of the male contact 50 through the conical connecting region 52.

The section of the sliding element that is still visible above the housing in this case features a laterally inclined V-shaped recess 30, into which a correspondingly flat tools such as, e.g., a screwdriver can be inserted in order to lever out an inserted sliding element. A bevel 17 is provided for the use of the tool in each chamber on the inner side of the housing wall surface. In other respects, a groove 31 is provided on the surface of the sliding element 20, wherein a tool for pressing the sliding element 20 into the housing 10 can be inserted into said groove.

When the sliding element 20 is pressed into its end position such that the limit stop 29 contacts the limit stop 16 of the catch element 15 at the end of the sliding element guide 21, the clamping sleeve 40 is pushed over the conical connecting region 52 such that the bunched conductors inserted therein are fixed between the inner wall of the clamping sleeve and the clamping shoulder 54 formed by the cone base.

Figure 2:
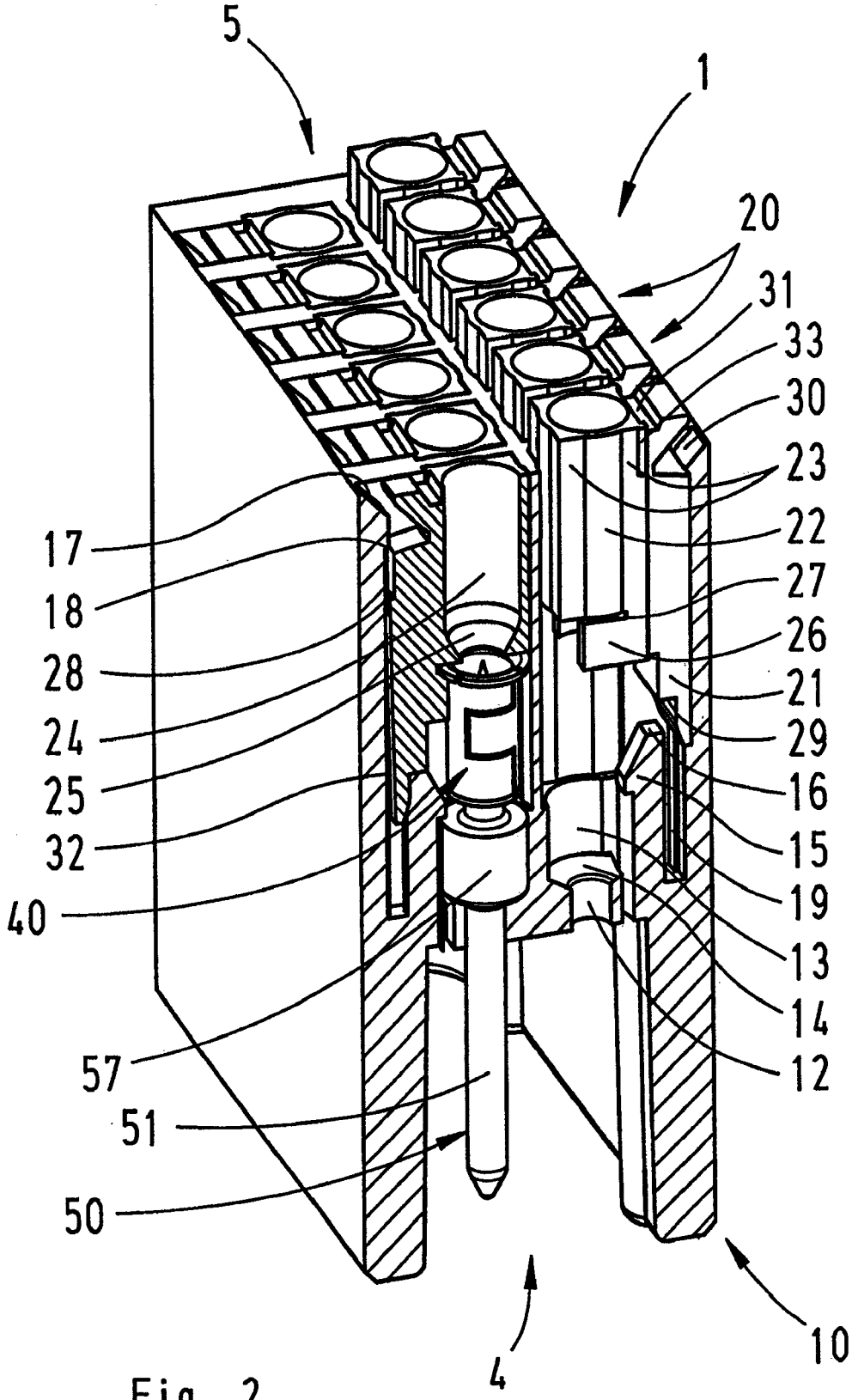
FIG. 2 is a connector half with a housing for male contacts in the from of a sectional representation viewed in the direction of the connecting region.

FIG. 2 shows the connector half 1 in the form of a perspective sectional representation viewed in the direction of the connecting region 5.

In this case, the left or front row of sliding elements is already inserted into the housing 10 while the right or rear row of sliding elements still protrudes from the housing.

The left front sliding element 20 is illustrated in the form of a sectional representation such that one can clearly ascertain that the narrowing funnel outlet 25 of the sliding element provided for inserting a bunched conductor has a smaller diameter than the clamping sleeve 40 arranged there under. This prevents individual wires of the bunched conductor from possibly getting stuck in the region of the bent holder 42 of the clamping sleeve.

The sliding element 20 is already illustrated in the lowered position in this case, wherein this figure also shows the contact between the limit stop 29 of the sliding element guide 21 and the catch element 15. If bunched conductors are inserted, the sliding element remains in this position because the clamping sleeve is held on the clamping shoulder 54 due to the widening of its diameter by the bunched conductors lying there between.

If no bunched conductors are inserted, the beads 33 integrally formed onto the corner regions 23 of the sliding element 20 prevent the sliding element from unintentionally sliding off in the direction of the male contact.

Figure 3:
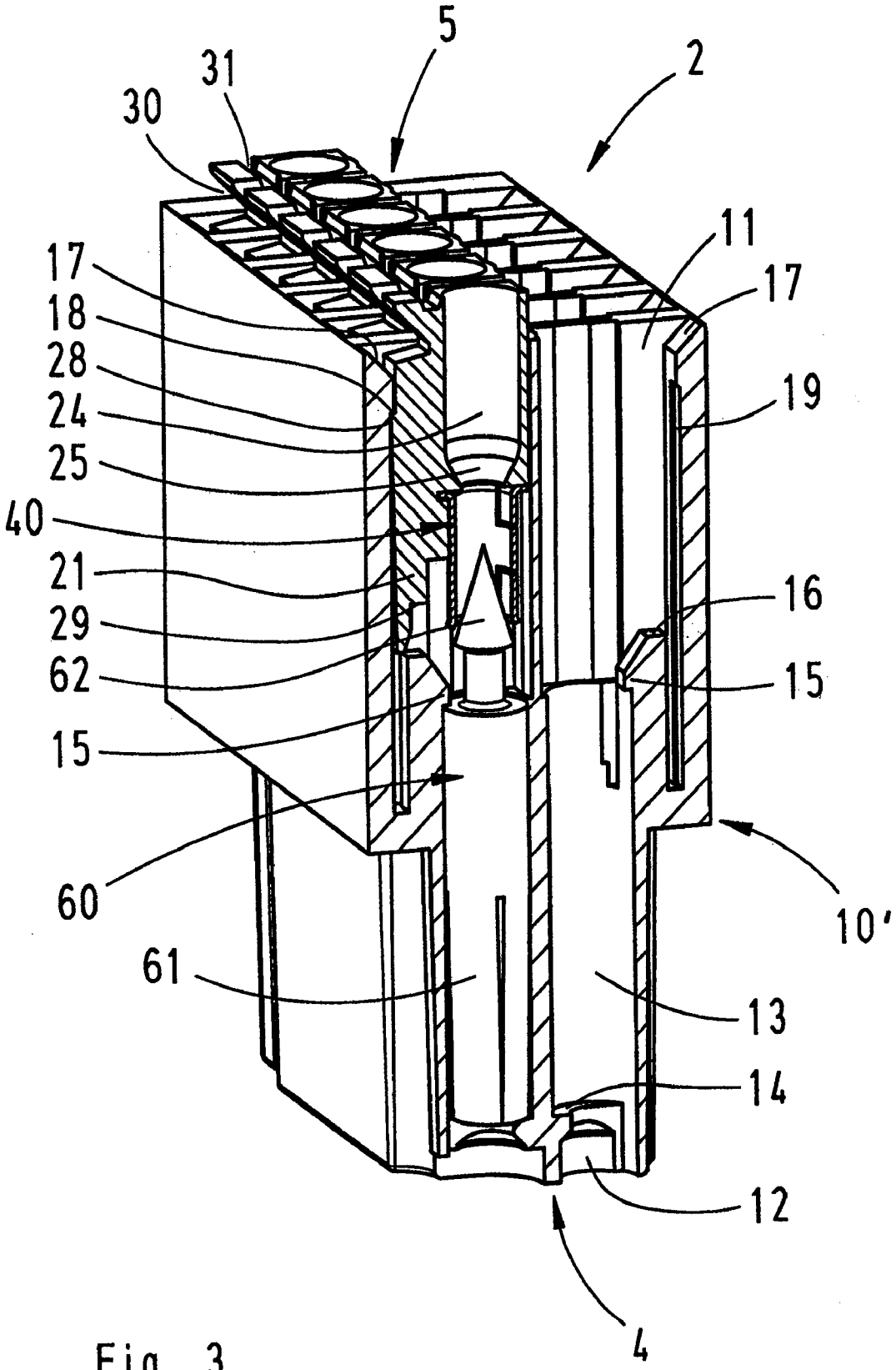
FIG. 3 is a connector half with a housing for female contacts in the form of a sectional representation.

FIG. 3 shows the connector half 2 with the connector housing 10' and at least one female contact 60 arranged therein in the form of a sectional representation.

One can ascertain from this illustration that the connector housing is basically designed similar to the housing that accommodates the male contact, but a slightly modified construction is required for accommodating the female contacts.

In this case, the female contact 60 is inserted into the tubular holding region 13 with the partially slotted terminal side 61 until the limit stop 14 is reached and locked in position by means of the catch elements 17.

According to this figure, in which the clamping sleeve 40 is also illustrated in the form of a sectional representation, the connecting region 62 consists of the conical point 63 on the connecting pin 66 that is adjoined by the stopping face 65 of the socket-shaped terminal side 61.

In this case, the conical point 63 already protrudes into the clamping sleeve 40 in the "wiring position" while the clamping shoulder 64 is still situated outside the clamping sleeve.

The lower end of the clamping sleeve 40 features an outwardly directed, funnel-shaped widening 44 that exerts a holding force upon the bunched conductors arranged between the clamping sleeve and the clamping shoulder with its inner wall during the lowering of clamping sleeve.

In addition, this figure clearly shows that a circular ring of sufficient size for inserting the wires of an electric bunched conductor is available between the clamping sleeve and the point such that the bunched conductor can, at best, contact the limit stop 65 underneath the clamping shoulder.

In this case, the inside diameter of the sleeve is chosen slightly larger than the diameter of clamping shoulder on the cone end of the connecting region of a male or female contact—however, at least so large that the smallest bunched conductor to be connected can already be reliably held.

Figure 4:
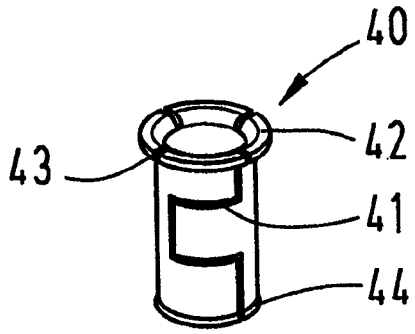
FIG. 4 is a clamping sleeve.

The clamping sleeve 40 shown in FIG. 4 is realized in the form of a rolled, springable clamping sleeve that features a meander-shaped slot 41 along the sleeve wall in order to ensure a spring effect when the sleeve is radially widened.

One of the ends is provided with an outwardly bent holding ring 42 that is interrupted several times by slots 43, wherein the opposite side features a funnel-shaped widening 44.

Figure 5:
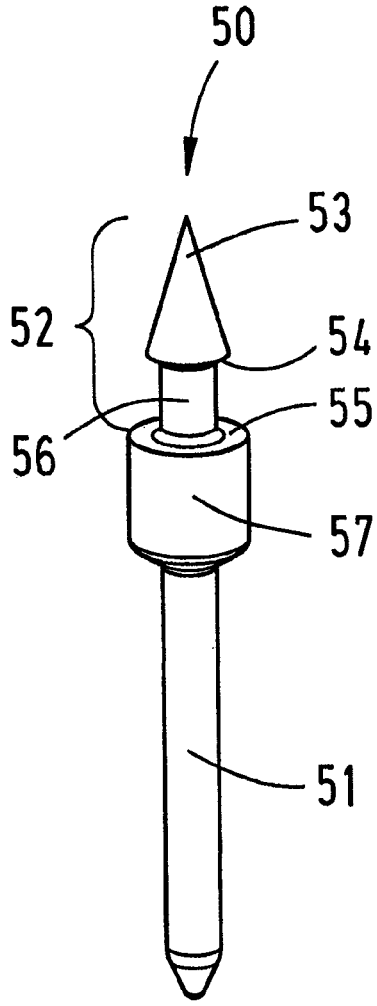
FIG. 5 is a male contact.

The male contact 50 shown in FIG. 5 is realized in the form of a turned part and features a pin-shaped terminal side 51 and a connecting region 52 with a conical point 53.

A cylindrical collar 57 is integrally formed between the terminal side 51 and the connecting side 52, wherein the annular surface of this collar that is directed toward the cone point is referred to as the stopping face 55. The conical point is integrally connected to the collar 57 with the aid of a connecting pin 56.

The edges of the cone base form a clamping shoulder 54, over which the springable clamping sleeve 40 is pushed during the connection of a bunched conductor such that it exerts a force that acts radially inward.

Figure 6:
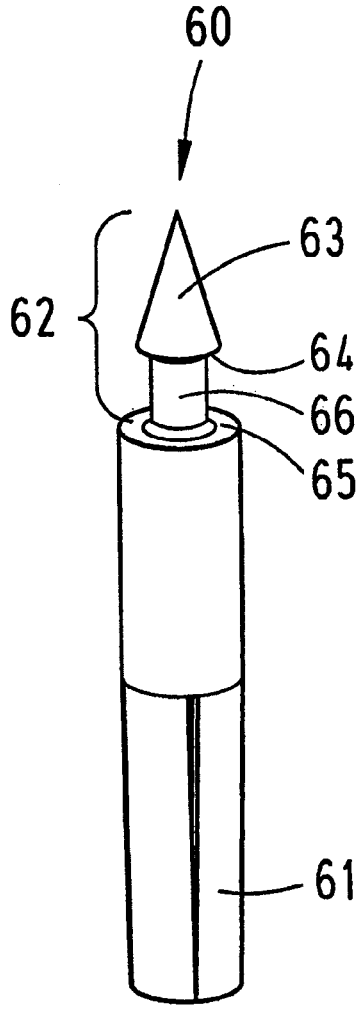
FIG. 6 is a female contact.

The female contact 60 shown in FIG. 6 features a terminal side 61 and a connecting side 62 analogous to the male contact 50. The terminal side is realized in the form of a partially slotted socket while the connecting region 62 features a conical point 63, on the cone base of which a clamping shoulder 64 is provided for fixing the bunched conductor by means of the clamping sleeve 40 placed over the connecting region 62.

Figure 7:
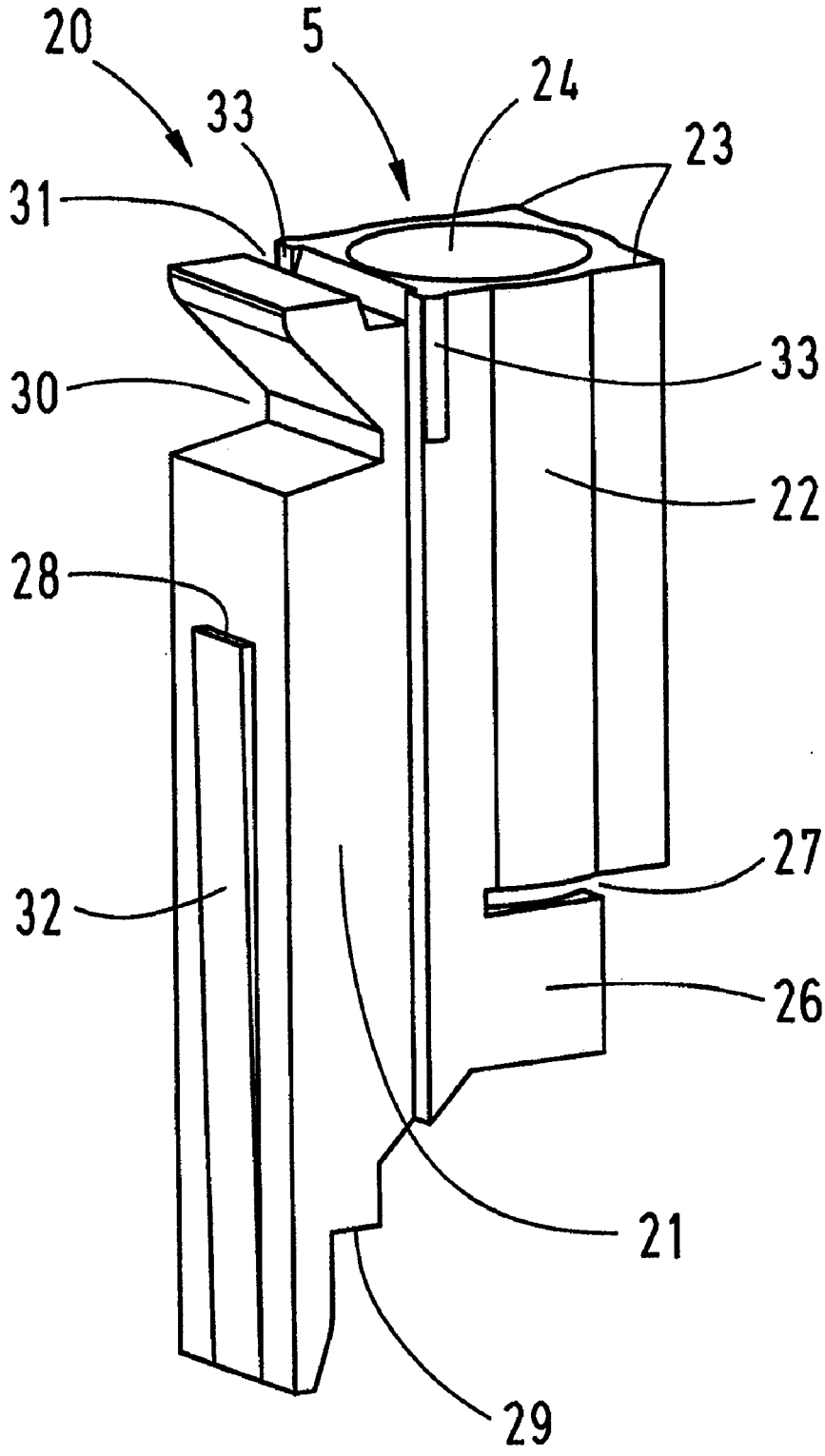
FIG. 7 is a perspective representation of a sliding element.

FIG. 7 shows an individual sliding element 20 in the form of a perspective representation. The round body 22 with the through-bore 24 and the corner regions 23 integrally formed thereon, as well as the integral sliding element guide 21, are also illustrated in this figure.

A wedge-shaped guide rail 32 with a stopping edge 28 protrudes from the outer surface of the sliding element guide, wherein said guide rail slides in the connecting direction in a correspondingly designed guide groove 19 in the chamber 11 of the connector housing 10, 10'. In this case, the stopping edge 28 comes in contact with the stopping edge 18 in the chamber in order to prevent the sliding element 20 from falling out.

The guide rail is interrupted by the V-shaped recess 30 that serves for inserting a simple tool in order to lever out a sliding element lowered into the chamber 11. The same tool as the one used for lowering the sliding element into the chamber can be inserted into a groove 31 provided above the recess 30 in the connecting region 5. In order to prevent an unused sliding element from sliding off into its chamber, beads 33 are integrally formed onto the corner regions 23 over a certain length on the side that points to the recess 30, wherein these beads protrude over the surface of the respective corner region such that they are pressed against the inner wall of the chamber 11 and thusly prevent the sliding element from unintentionally sliding off due to their inhibitive effect.

Figure 8A:
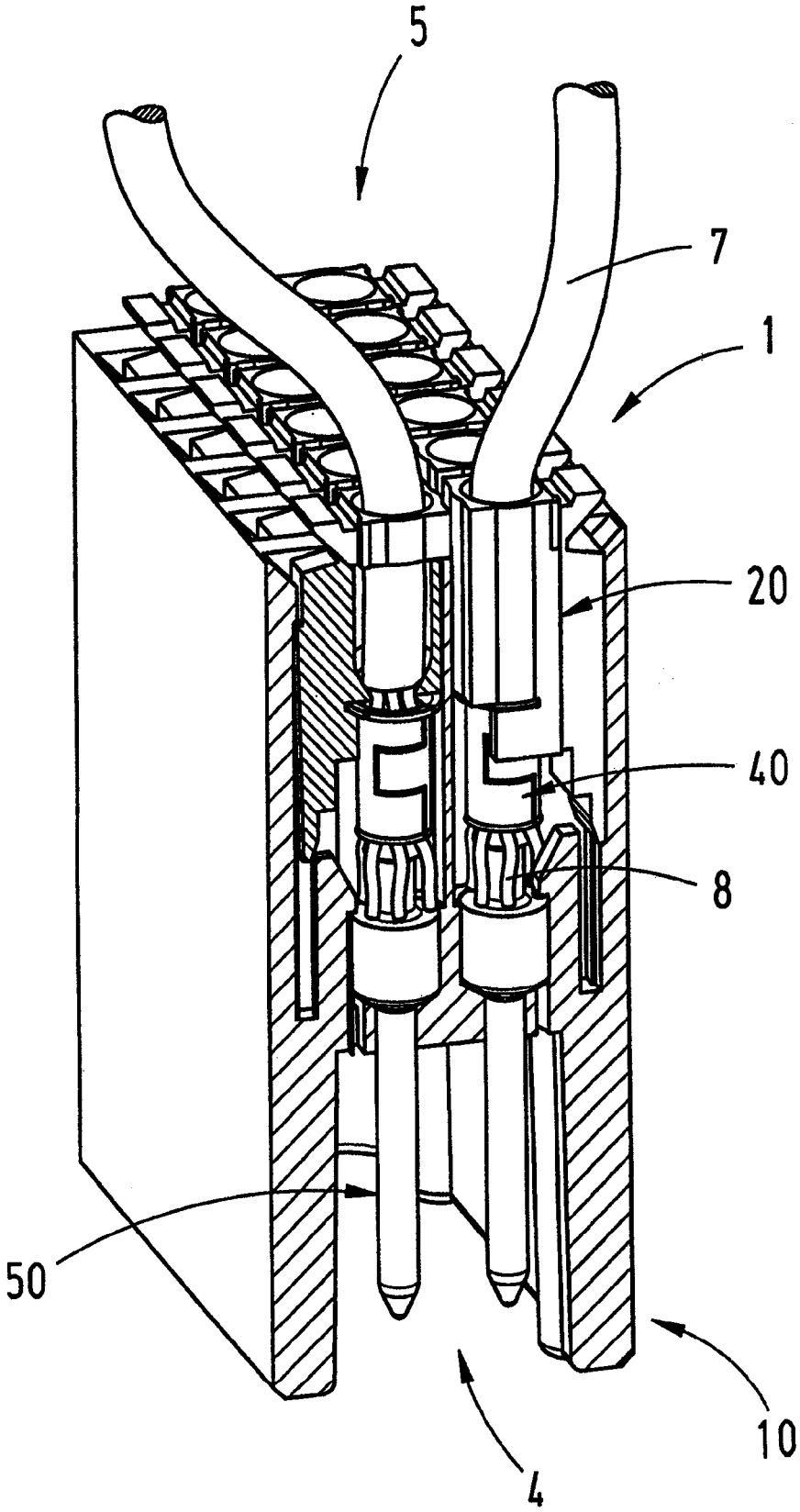
FIGS. 8*a* and 8*b* are perspective views showing the function of the connecting device with bunched conductors.
Figure 8B:
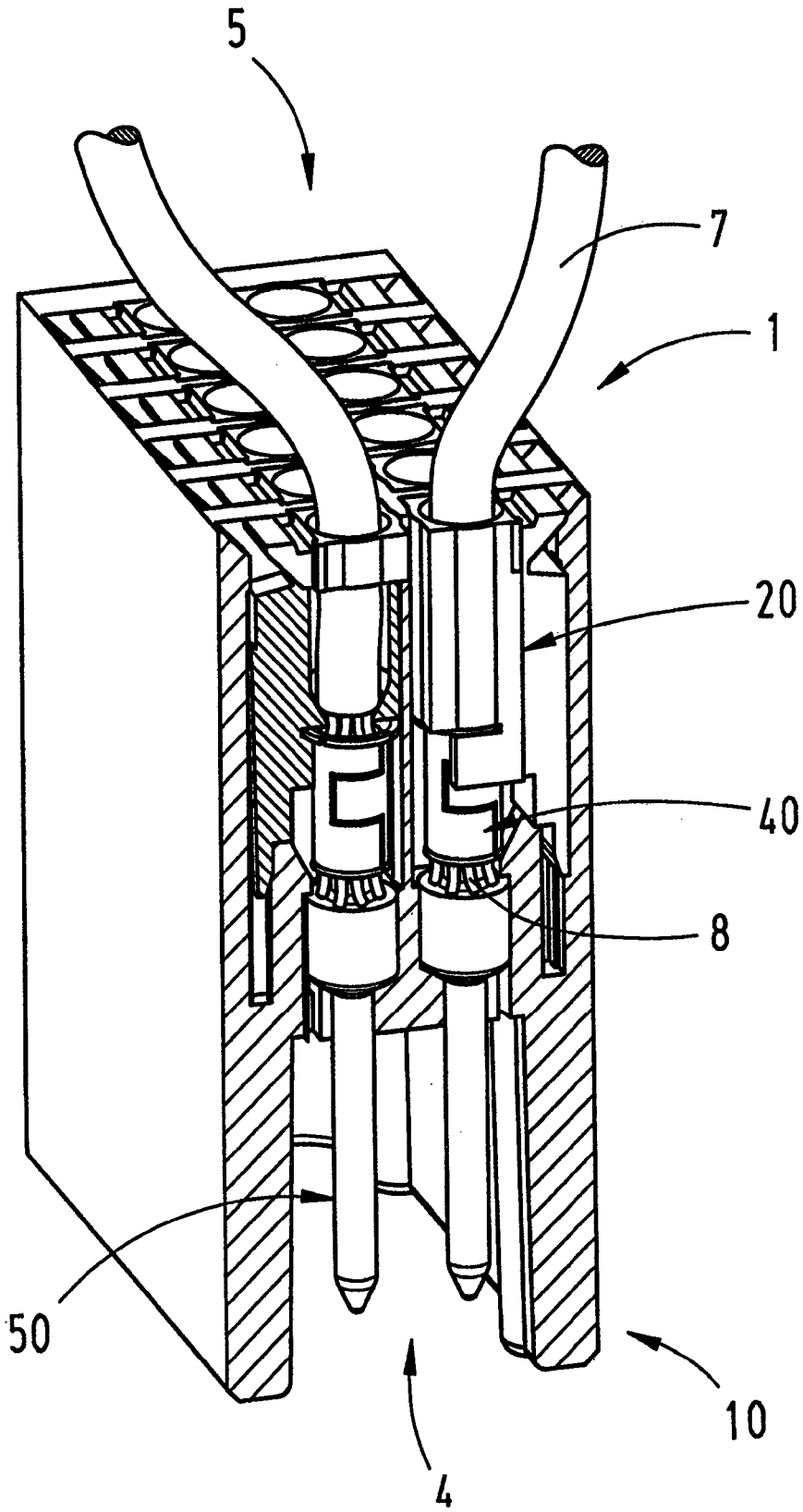

FIGS. 8*a* and 8*b* show the interaction of the connecting device formed by the sliding element 20, the clamping sleeve 40 and the connecting region of a male contact 50 with a bunched conductor 7 inserted therein, namely in the form of a section through a housing 10 for male contacts. The individual wires 8 of the bunched conductor 7 are initially stripped by a predetermined length that should be slightly longer than the length of the clamping sleeve 40.

The bunched conductor 7 is then inserted into the through-bore 24 of the sliding element 20 such that its coating approximately protrudes as far as the funnel outlet 25, wherein the individual wires 8 protrude at least over the clamping shoulder 54 underneath the clamping sleeve 40.

Subsequently, the sliding element 20 is pressed into the housing 10 such that the individual wires are displaced over the cone point 53 by the travel of the sliding element and reliably positioned on the clamping shoulder of the connecting region where they are fixed by the widening, but springable clamping sleeve 40 depending on their number and thickness.

Figure 9:
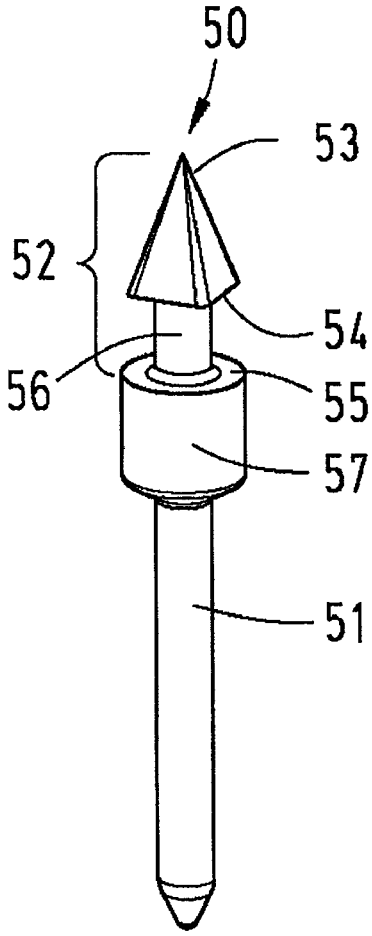
FIG. 9 is a variation of a male contact.
Figure 10:
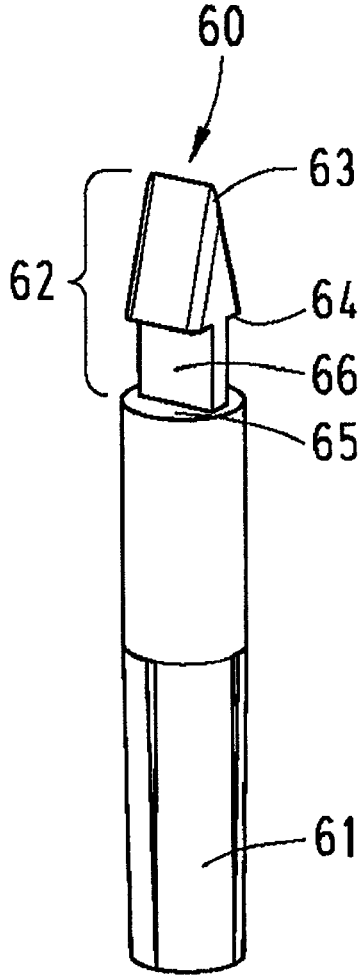
FIG. 10 is a variation of a female contact.

FIGS. 9 and 10 show other types of connection region 52 of a male contact 50 and connection region 62 of a female contact 60 formed like a pyramid with an apex 53 and four clamping shoulders 54, and furthermore formed like an arrow 62 with an apex 63 and two clamping shoulders 64.

Figure 11:
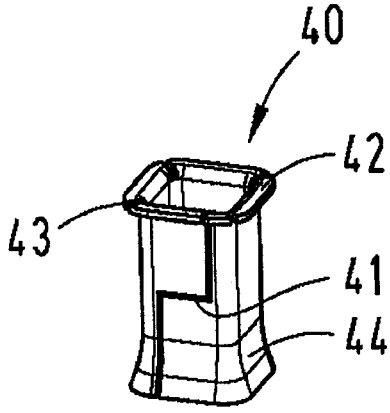
FIG. 11 is a variation of a clamping sleeve.

In FIG. 11 is displayed a clamping sleeve 40' with the meander-shaped slot 41 for the connecting regions 52, 62 of FIGS. 9 and 10.

What is claim is:

1. A connecting device for electric bunched conductors in an electric connector housing with male contacts and/or female contacts that are arranged in separate chambers and feature a connecting region formed by a volumetric body unit with an apex and a clamping shoulder, wherein a clamping sleeve is fixed in position on a sliding element such that it is axially aligned with a through-bore, and wherein the clamping sleeve can be pushed on and pulled off the connection region of the male or female contacts together with the sliding element, wherein a radial force of the clamping sleeve acts upon and fixes the bunched conductors inserted between the clamping sleeve and the clamping shoulder.

2. The connecting device according to claim 1, wherein the clamping sleeve features a meander-shaped longitudinal slot, as well as a bent holding ring that is slotted several times and a funnel-shaped widening.

3. The connecting device according to claim 1, wherein a fork-shaped holder for accommodating the clamping sleeve is provided on the sliding element.

4. The connecting device according to claim 1, wherein the displaceable sliding element can be levered out of the connector housing by a certain distance with the aid of a tool that can be inserted into a recess.

5. The connecting device according to claim 1, wherein the sliding element features a round body with angular corner regions integrally formed thereon on the side that points to the connecting region, and a bead is integrally formed onto both corner regions that point to the recess.

6. The connecting device according to claim 1, wherein the sliding element is axially guided in a guide groove in the housing by a guide rail.

7. The connecting device according to claim 1, wherein mutually contacting stopping edges are arranged on the housing and on the sliding element.

8. The connecting device according to claim 1, wherein the volumetric body unit of the connection region is formed in a cone-shaped, or a polygon-shaped structure.

9. The connecting device according to claim 1, wherein the volumetric body unit of the connection regions is formed in a pyramid-shaped or an arrow-shaped structure.

* * * * *